US010932513B1

(12) United States Patent
Day et al.

(10) Patent No.: US 10,932,513 B1
(45) Date of Patent: Mar. 2, 2021

(54) WEARABLE FAR-UVC WITH INTEGRATION IN WEARABLE PERSONAL PROTECTIVE EQUIPMENT (PPE), HEADGEAR, BASEBALL CAPS, HELMETS, NECKLACES, ANKLETS, BRACELETS, AND OTHER APPAREL TO INACTIVATE AND PROTECT FROM VIRUSES AND MICRO-ORGANISMS

(71) Applicants: Alan Cook Day, Youngsville, LA (US); Michele Marie Day, Youngsville, LA (US)

(72) Inventors: Alan Cook Day, Youngsville, LA (US); Michele Marie Day, Youngsville, LA (US)

( * ) Notice: Subject to any disclaimer, the term of this patent is extended or adjusted under 35 U.S.C. 154(b) by 0 days.

(21) Appl. No.: 16/940,663

(22) Filed: Jul. 28, 2020

(51) Int. Cl.
*A42B 1/24* (2021.01)
*A41D 19/00* (2006.01)
*A42B 1/244* (2021.01)

(52) U.S. Cl.
CPC ..... *A42B 1/24* (2013.01); *A41D 19/0024* (2013.01); *A42B 1/244* (2013.01)

(58) Field of Classification Search
CPC ..... A41D 13/1192; A41D 19/0024; A62B 18/00; A62B 18/10; A62B 23/02; B01D 46/00; A42B 1/244; A42B 1/24
See application file for complete search history.

(56) References Cited

U.S. PATENT DOCUMENTS 6,056,413 A * 5/2000 Urso ..... A42B 1/244 362/106
6,721,962 B1 * 4/2004 Polaire ..... A42B 1/244 2/209.13
6,994,445 B1 * 2/2006 Pomes ..... A42B 1/242 2/209.13
7,234,831 B1 * 6/2007 Hanley ..... A42B 1/244 2/209.13
2005/0078473 A1 * 4/2005 Zuloff ..... A42B 1/004 362/106
2005/0186258 A1 * 8/2005 Wang ..... A61B 42/00 424/443
2007/0101867 A1 * 5/2007 Hunter ..... A61L 9/205 96/224
2009/0235934 A1 * 9/2009 Martin ..... A62B 18/10 128/206.15
2012/0279503 A1 * 11/2012 Zhou ..... A41D 13/1192 128/205.27
2014/0268683 A1 * 9/2014 Waters ..... A42B 1/244 362/106

(Continued)

FOREIGN PATENT DOCUMENTS

KR 2020020747 A * 2/2020

*Primary Examiner* — Tajash D Patel

(57) ABSTRACT

Wearable Far-Ultra Violet C (Far-UVC) head article with components thereof and other accessories is provided to protect the wearer from intrusion of viruses and micro-organism. The head article is integrated with Far-UVC photons on a brim that project wavelengths of about 222 nm safely in front of the face to protect against viruses. The head article would be a baseball type cap with Far-UVC photons attached in a channel perpendicular to the axis on the brim on a fore edge underneath a surface thereof projecting the wavelength of sterilizing rays in front of the face while protecting the skin and eyes.

3 Claims, 4 Drawing Sheets

(56) References Cited

U.S. PATENT DOCUMENTS

| | | | | |
|---|---|---|---|---|
| 2015/0063777 | A1* | 3/2015 | Letke | H04N 5/23206 386/224 |
| 2015/0375008 | A1* | 12/2015 | Gretz | A61N 5/0618 607/90 |
| 2019/0275358 | A1* | 9/2019 | Yao | A62B 23/02 |
| 2020/0061399 | A1* | 2/2020 | Wade | A62B 18/025 |

* cited by examiner

Fragmented Diagram Side View

Diagram Side View

WEARABLE FAR-UVC WITH INTEGRATION IN WEARABLE PERSONAL PROTECTIVE EQUIPMENT (PPE), HEADGEAR, BASEBALL CAPS, HELMETS, NECKLACES, ANKLETS, BRACELETS, AND OTHER APPAREL TO INACTIVATE AND PROTECT FROM VIRUSES AND MICRO-ORGANISMS

CROSS-REFERENCE TO RELATED APPLICATIONS

This application is the first U.S. patent application, which claims benefit of U.S. Provisional Application No. 63/102,153 filed Jun. 1, 2020 which are all hereby incorporated herein by reference in their entirety.

FIELD OF THE INVENTION

The field relates to Wearable Far-UVC devices and, in particular to Wearable Far-UVC Headgear such as baseball caps but is not limited to such devices and can include helmets, gloves, jewelry, and other wearable devices capable of providing anti-virus protection for a wearer.

BACKGROUND OF THE INVENTION

With the pandemic of Coronavirus (COVID19) first identified in December 2019 then reported as a pandemic by the World Health Organization on Mar. 11, 2020, Far UVC photons can be used for preventing the spread of the COVID19. In addition, other types of viruses and micro-organisms can be inactivated by Wearable Far-UVC apparel while traveling or in crowded venues. The application of Far-UVC photons on wearable attire may be beneficial to eliminating viruses.

Far-UVC photons are used to sterilize surfaces. When combined with PPE and other wearable apparel, they may prove beneficial in reducing the spread of viruses within crowds at hospitals, emergency rooms, construction sights, athletic stadiums, festivals, carnivals, schools, colleges, churches, work environments, airports, malls, cities, or any venue with crowds of people.

Individuals desire protection from viruses and micro-organisms currently wear face masks and other personal protective gear. Masks are limited in usage with the potential of viruses penetrating material construction of the mask. As a result, Wearable Far-UVC will provide safe virus killing rays emitted from the underside fore-rim of the cap, to project in front of the face perpendicular to the axis of the rim, protecting the wearer from viruses and other micro-organisms. The Far-UVC wavelength is a safe distance from the skin and eyes with the additional safety measure of using a 222-nanometer wavelength not harmful to the wearer's skin and safe to third parties.

Conventional use of lighted headgear known includes the usage of incandescent lights and fiber. Wearable attire, particularly headgear affixed with Far-UVC is not currently known to be used in protecting against viruses and micro-organisms. Wavelengths of Far-UVC at a specific nanometer will provide a virus resistance not found in other light sources. Far-UVC photons affixed to the perimeter rim portion of headgear, in particular a baseball cap rim, will project perpendicular to the axis of the cap mounted in front of the face and not on the face or eye, thus guarding the wearer from viruses in particular Covid19 and other micro-organisms. With these caps, a wearer could prevent a virus from coming into contact with the wearer's face, blocks the dispersion of the virus from the wearer and if infected acts a protective barrier for the wearer and third parties in proximity.

Wearable Far-UVC fulfills a need among the masses to contain and eliminate the spread of viruses and ward off future viruses and micro-organisms. The preferred headgear is a baseball hat which could be comfortably worn in large social settings, church gatherings, colleges, schools, restaurants, and anywhere groups of people gather. A priority would be to maintain rather than limit the baseball hat design by affixing Far-UVC photons in a non-evasive manner on the fore-perimeter under the rim. Batteries aligned in the underside crown cap portion would be covered with a Velcro covering for ease in removing said batteries or any other power source such as solar, electromagnetism, and or acoustic sound.

For example, U.S. Pat. No. 200620008165 discloses an antivirus respirator protection face shield, comprises a shield for mouth and nose and a filtering pot. The filtering material adopts new-type virus-filtering material, guaranteeing effect of virus filtering. The filter may not kill viruses and is constricting over the face. Whereas Wearable Far-UVC headgear provides anti-virus rays over the face protecting against the penetration or dispersion of viruses and micro-organisms.

In another example, U.S. Pat. No. 6,056,413 to Urso discloses a light connected to a visor of a baseball-style cap. The light of Urso is a light bulb based in a socket with the light being pivotally connected to the underside of the visor. The light is merely for illumination and does not include Far-UVC photons which are strategically placed for sterilization against viruses and micro-organisms penetrating the wearer or from viruses dispersing from the wearer.

In another example, U.S. Pat. No. 6,994,445 to Pomes describes a baseball cap having a light source inside a brim portion of the hat. In one embodiment, the light source is mounted within a recess compartment of the brim so as to be oriented in a horizontal or parallel position relative to the fore-and-aft axis of the brim. This design is strictly for illumination and does not use biophysically based Far-UVC electromagnetic wavelengths utilized for germicidal purposes.

SUMMARY OF THE INVENTION

In one aspect, Wearable Far-UVC Headgear is disclosed where a plurality of Far-UVC photons are affixed to the cap fore-rim providing a downward projection of wavelengths perpendicular to the horizontal axis of the rim in front of the wearer face for protection from viruses and micro-organisms penetrating the wearer or viruses dispersing from the wearer. Source can include several Far-UVC photons to project downward electromagnetic wavelengths of 222 nanometer wavelengths to kill viruses without damage to living cells in the human skin or human eye. Such Wearable Virus Far-UVC caps advantageously allow a wearer protection from viruses while in close proximity to other people at places like an airport, school, work, church, store, restaurant, bar, or stadiums. Far-UVC photons would be powered by energy sources such as batteries but not limited to and can include other power sources such as solar and electromagnetism In another form, a Far-UVC receptacle for affixing to a sunhat as well as headgear with the Far-UVC affixed thereto is disclosed. The Far-UVC holder may be affixed to the perimeter underneath the rim of the sunhat for positioning the Far-UVC sources in a particular orientation. In one aspect, the Far-UVC receptacle includes a heat-resistant base and at least seven Far-UVC components or elements that project in a downward and oblique angle of inclination away from the base with the prescribed Far-UVC intensity to protect against viruses and microorganisms. The receptacle portions or components are sized to receive the Far-UVC photons and, in one approach, maintain multiple photons at the same fixed oblique angle of inclination relative to the base. Thus, the Far-UVC holder allows multiple Far-UVC sources to be secured to headgear in a relaxed manner to provide electromagnet wavelengths in a downward prescribed direction. In another aspect, the Far-UVC modules are affixed in such a manner to be streamlined and natural with the familiar design of the sunhat thus eliminating any visual or esthetic distraction. The Far-UVC holder allows it to be affixed under the of rim structure without detracting from the functionality or appearance of the headgear and without visual interference to the wearer.

In one form, the Far-UVC receptacle is attached to the various headgear such as helmets, PPEs, and jewelry such as bracelets and necklaces, via a 4.5 inch flexible cohesive strip portion located on the headgear brim, such as along a portion of the covering material extending about the rim. Through one, the Far-UVC photons, are secured within a rounded yet flexible beveled elongated channel with an opening for specific electromagnetic wavelengths directed in front of the wearer's face. The heat resistant channel inserted with Far-UVC will be affixed with a waterproof cohesive strip on the rim covering material rather than to the shape retentive insert of the hat rim. The Far-UVC beveled elongated channel is preferably secured to the covering material with adhesive.

Moreover, the elected headgear with the channel positioned on the underside forefront of the rim embeds several 0.25 inch in length and 0.25 inch width Far-UVC photons emitting 222 nanometer wavelengths, that are affixed to the beveled open channel on the underside rim perpendicular to the horizontal axis of the rim portion of the cap thereof in non-interference with the vision of the wearer. The Far-UVC photons within the receptacle project electromagnetic wavelengths directly down from the underside of the rim so as to emitting 222 nm anti-virus wavelengths on the frontal portion not projecting onto the wearer's face and eyes. The intensity of Far-UVC can be powered by energy sources such as batteries but not limited to and can include other power sources such as solar and electromagnetism housed in a battery compartment enclosed within the inner cap with placement above the wearer's head affixed with waterproof adhesive. The 4-inch battery compartment will be housed directly within the orb of the cap covered with a 5 inch in length and 0.24 inch in depth foam fabric comfortable to the wearer along with a Velcro adhesive to open for inserting batteries.

A small wire will affix to the side of the headgear to the rim mounted with the channel embedded with the Far-UVC photons. Thus, the headgear maintains an optimal direction of the Far-UVC photons thereon so that they are not intrusive. Additionally, the baseball cap maintains the headgear traditional presentation, and is efficiently constructed for the correlated electrical wiring design, subsequently described.

DETAILED DESCRIPTION OF THE PREFERRED EMBODIMENTS

In general, the various aspects described herein relate to Wearable Far-UVC, components thereof, and other accessories therefor. As further described below, the Wearable Far-UVC may include headgear such as PPEs, hats, with regard to baseball caps, sunhats, cowboy hats, hoods, visors, military or law enforcement helmets or headgear, bike helmets, gloves, jewelry, and other wearable devices positioned thereon to provide Wearable Far UVC electromagnetic wavelengths in a forward and/or downward direction from the wearer.

In one aspect, the Far-UVC photons are able to provide emitting electromagnetic wavelengths in a downward direction while maintaining a comfortable design associated with familiar baseball cap headgear among other designs. Multiple Far-UVC photons may be positioned on a rim of the headgear to direct Far-UVC rays as a barrier in front of the wearer's face from airborne viruses. The Far-UVC channel housing the photons may be attached to an inside surface of the rim via the affixed section using adhesive, sewing, stitching, ultrasonic welding, Velcro, or other suitable fastening techniques so that the Far-UVC channel is minimally view underneath the forefront of the rim.

In general, Wearable Far-UVC and other headgear described herein include sources, such as Far-UVC's, affixed at the forward locations on the underside of the rim of the cap. To power these Far-UVC sources, a variety of distinctive collections can also be utilized to operate diverse energy sources. Energy mechanisms to generate power can include electromagnetism, solar, wind, kinetic energy, renewable energy, or a variety of standardized batteries. For example, a solar panel could be constructed in the rim of the hat to provide sustaining power to the Far-UVC sources. A charging port may be preferable necessitating a port in the lower edge of the rim. Far-UVC can be affixed to an assortment of wearable attire including PPE's, helmets, gloves, jewelry, and the like.

Figure 1:
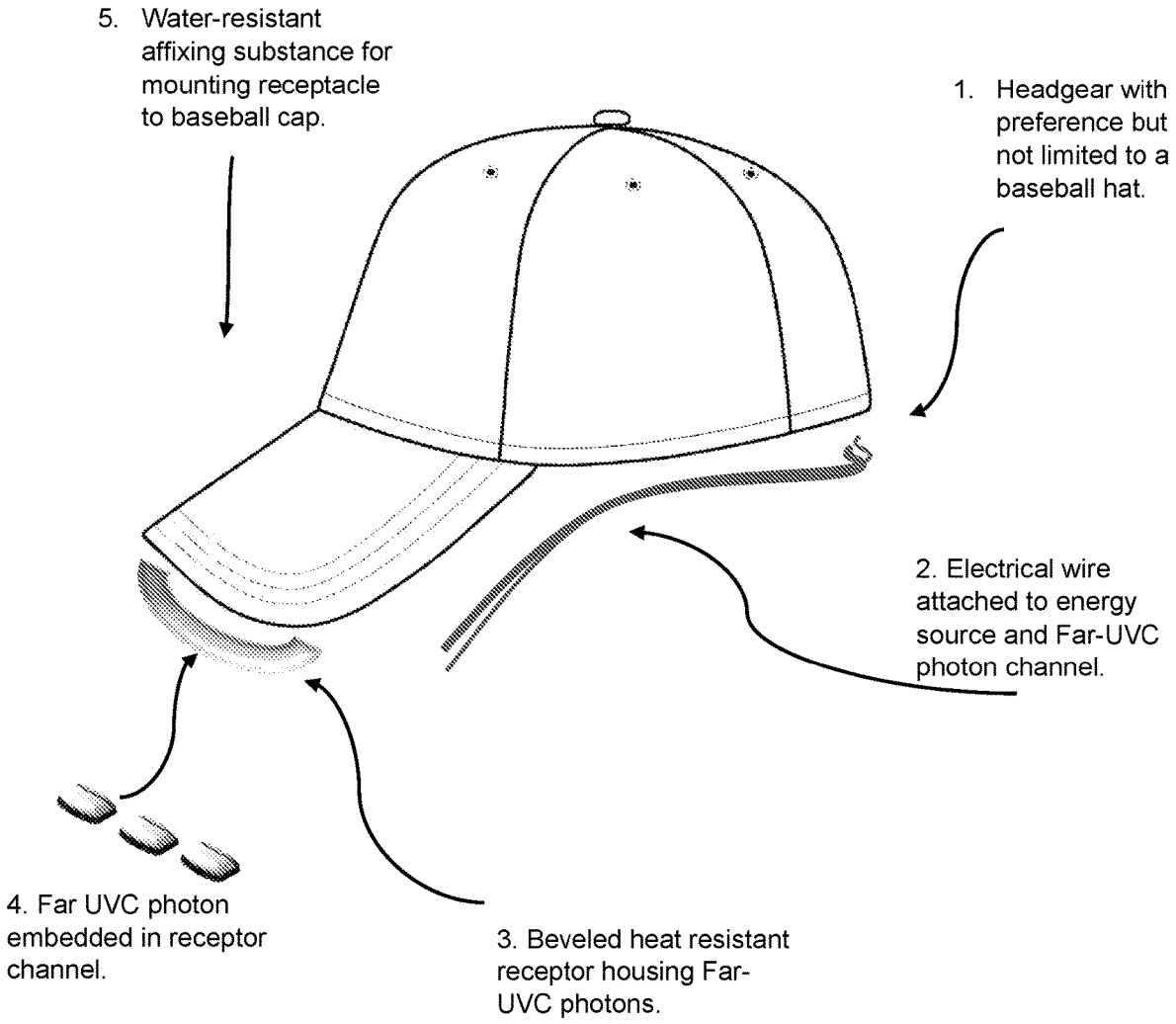
FIG. 1 is a fragmented side sectional view of the rim of a baseball cap having Far-UVC photon sources affixed perpendicular to the horizontal axis of the rim thereto projecting electromagnet wavelengths in a specified downward direction. (1) Headgear with preference to baseball caps, but not limited to this design. (2) Electrical wire connected to an energy source such as batteries but not limited to and can include other power sources such as solar and electromagnetism within cap and beveled receptor encasing Far UVC sources. (3) Far UVC photons embedded within a waterproof and heat resistant channel. (4) Far UVC photons embedded in channel. (5) Water resistant affixing substance for mounting receptacle to baseball cap.

FIG. 1 In this embodiment, the Far-UVC source may be affixed to a baseball cap and, in particular, to a rim portion.

Figure 2:
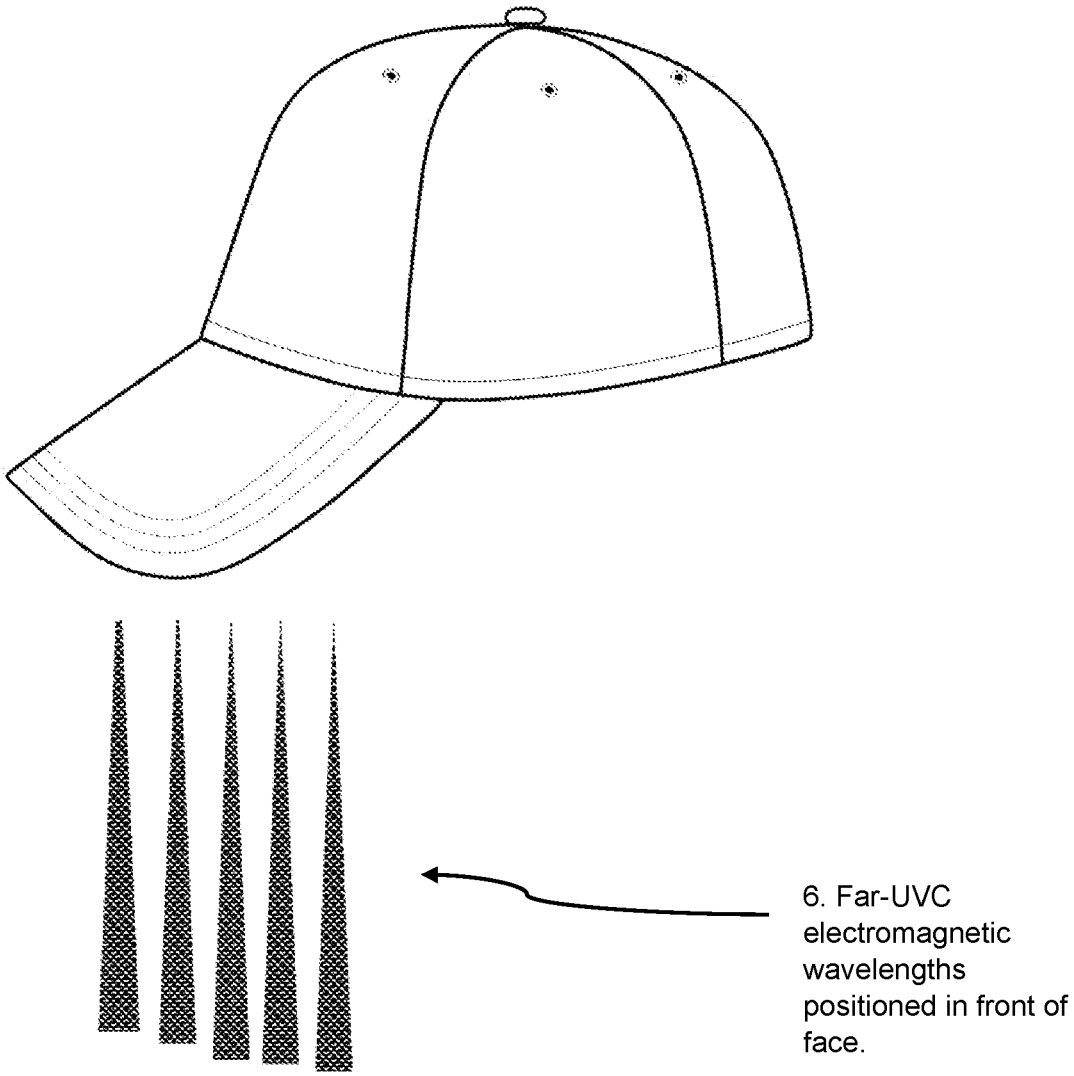
FIG. 2 is a side view of the headgear with the Far-UVC electromagnetic wavelengths (6) positioned underneath the rim edge perpendicular to the horizontal axis of the rim and emanating downward from the headgear rim directed front of the face of the wearer.

In referring FIG. 2, the Far-UVC source is affixed on the underside of the fore rim with a 90 degree or 120 degree angle relative to the rim so that the electromagnetic wavelengths are focused downward and forward of the rim between about 90 degrees to about 120 degrees and can be angled based upon the configuration of the cap to prevent viruses from attaching to the facial area. The 222-nanometer considered in the Far-UVC range is anti-viral and considered safe for the wearer. It also does not interfere with third party viewers in contact with the wearer of the cap. For example, the Far-UVC baseball cap could be utilized by college students to prevent the spread of viruses.

For powering the Far-UVC source, the cap may include at least one, and alternatively two battery receptacles affixed to the cap. Respectively, one energy receptacle for said energy source such as batteries but not limited to and can include or any other power sources such as solar, acoustic technology, and electromagnetism is electrically attached to both Far-UVC photos, but in this configuration, one energy source is electrically connected to the Far-UVC photon source. Extra energy power can be provided as a backup energy source.

Figure 3:
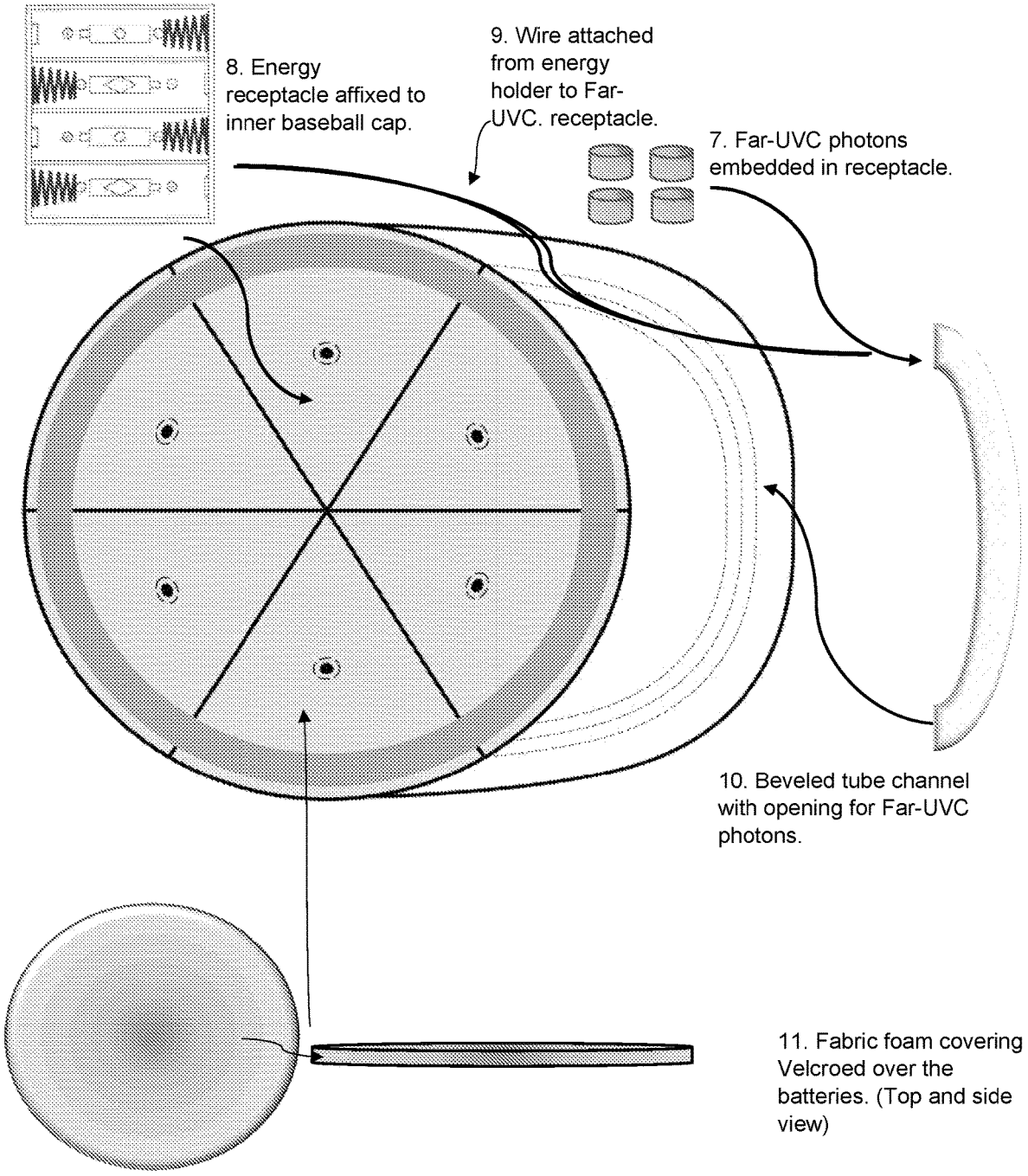
FIG. 3 is a fragmentary bottom inside view of the cap showing the Far-UVC components positioned underneath the edge of the rim perpendicular to the horizontal axis of the rim providing sterilizing electromagnetic wavelengths in a downward angle direction relative to the rim. (7) Far-UVC sources embedded in receptacle. (8) Receptacle for energy source such as batteries or other energy source such as or any other power source such as solar and electromagnetism affixed to inner baseball cap. (9) Wire attached from energy source holder such as batteries but not limited to and can include other power source such as solar and electromagnetism to connect Far-UVC photos. (10) Beveled tube-like channel with opening for Far-UVC sources. (11) Fabric foam covering Velcroed over the energy source such as batteries but not limited to and can include or any other power source such as solar and electromagnetism. (Top and side view)

Referring to FIG. 3, the Far-UVC cap includes a Far-UVC flexible curvature holder or affixing ensemble for attaching the channel to the bottom portion of the rim. The Far-UVC channel may be secured to the rim and structured to direct wavelengths downward in front of the wearer's face without obstructing the view or a glare on glasses and sunglasses.

Referring to FIGS. 1-4, one form of the Far-UVC channel or ensemble is displayed in precise detail. By one approach, the photons include a bevel cylinder curvature channel or lodging allocation or Far-UVC photons. Preferably, the affixed infrastructure includes a flexible curvature design that is thin so as to not detract from the traditional design of the headgear with reference to the baseball cap design. The flexible curvature of the affixed Far-UVC channel is shown in FIG. 3. The Far-UVC affixed infrastructure thereof, may be constructed from bendable and water-resistant substances, for example rubber or plastic substances so that the infrastructure forms a fluid arch to the rim of the baseball cap (not limited to this embodiment). In alignment with such substances, additional moldable and bendable elements may be used in the construction of the Far-UVC channel including rubber-type substances and other conforming elements. Additionally, the Far-UVC channel can be constructed with heat-resistant material, aluminum, or other heat-resistant substance suitable for the heat energy of Far-UVC photons.

The affixed Far-UVC channel has an attenuate receptacle beveled and curved with a direct opening for the Far-UVC wavelength. The fore axis infrastructure extends along and away from the affixed channel and generally is parallel to the opposite side edges and generally perpendicular to opposite the front edges.

Figure 4:
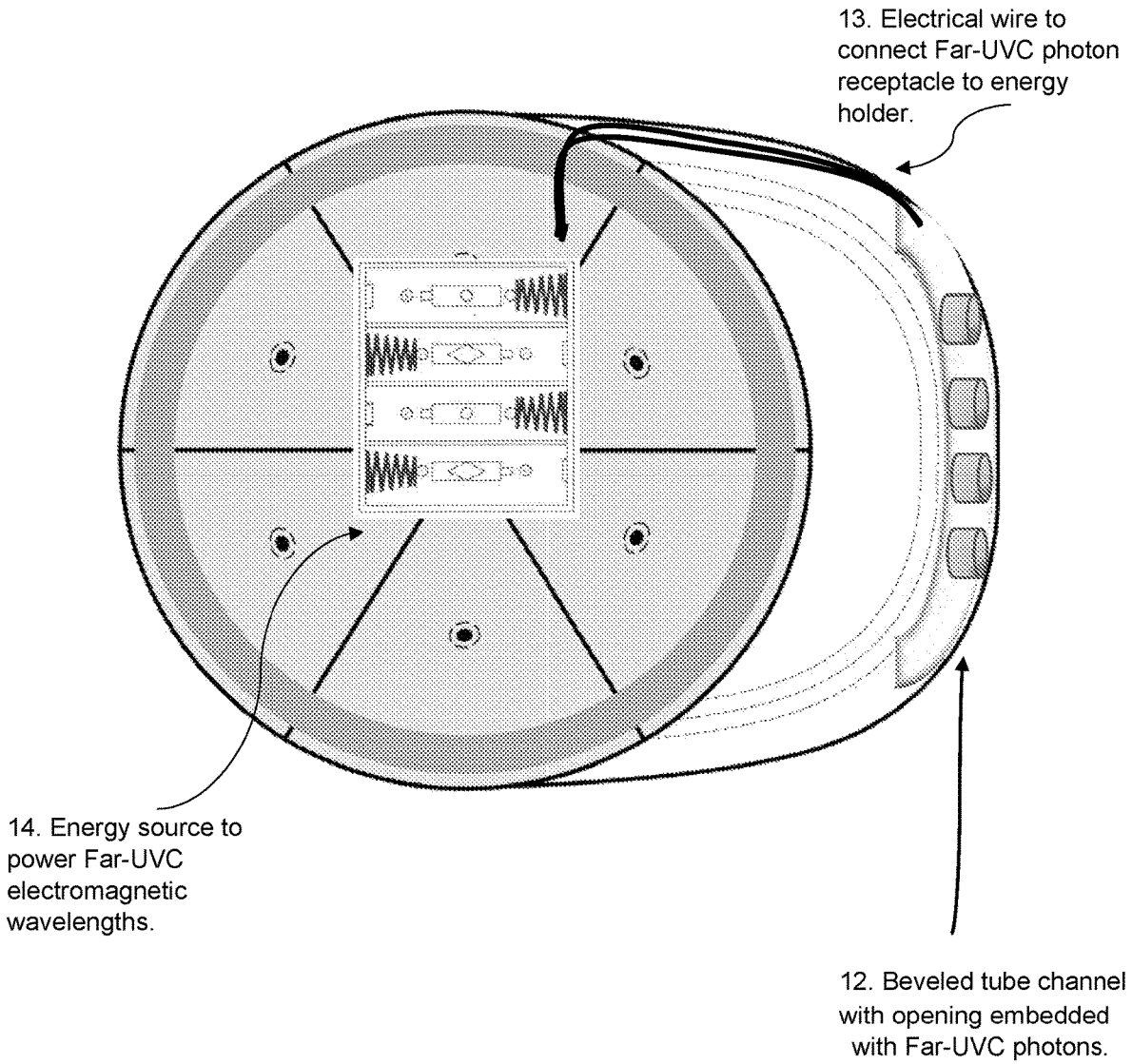
FIG. 4 is a bottom perspective view of a Wearable Far-UVC cap showing a Far-UVC holder for mounting Far-UVC sources to a bottom edge portion of the rim perpendicular to the horizontal axis of the rim. (12) Beveled tube channel with opening embedded with Far-UVC photos. (13) Electrical wire to connect Far-UVC photon receptacle to battery holder. (14) Energy receptor for said energy such as batteries but is not limited to and can include other power sources such as solar and electromagnetism to power Far-UVC electromagnetic wavelengths.

The Far-UVC photons are connected to the infrastructure and constructed to secure the Far-UVC photons therein. Through one approach the Far-UVC sources are fluidly combined with the affixed receptacle to provide a unified solid infrastructure and securing the Far-UVC photon sources. In FIG. 4, the Far-UVC photons and receptacle are conjoined as one-structure with an opening for specific wavelength intensity proportioned to the frequency allocated to protect from viruses. In one scenario, the receptacle axis on the rim is angled approximately 90 degrees to approximately 120 degrees from the rim axis, which guides the Far-UVC electromagnetic wavelengths to the angles ranging from about 90 degrees to approximately 120 degrees from the plate axis.

In one example, the embedded source of the Far-UVC photons receptacle may have a beveled, cylindrical, and unhindered channel within the affixed receptacle to configure exact Far-UVC electromagnetic wavelength for precise design. Each unhindered tube has compartments to power Far-UVC photons.

The Far-UVC receptacle serves as an infrastructure for the Far-UVC photons so that the receptacle is attached to the rim and to the electrical wiring to the battery holder in a seamless design. Overview design includes the Far-UVC receptacle affixed to the rim, the Far-UVC photons embed in the modules of the infrastructure and are connected to the wiring for the battery energy pack within the head of the cap.

Affixing the Far-UVC receptacle of an attenuated size under the rim as mentioned is compatible with a traditional baseball cap design.

The modules of the Far-UVC may expand only a minor length so as to appropriately provide anti-virus Far-UVC electromagnetic wavelengths while maintaining a subtle appearance to third party viewers and not being intrusive to the wearer. This design composition provides strategic electromagnetic wavelengths that will project strategically.

Utilizing the Far-UVC receptacle affixed under the baseball cap rim is beneficial in electrical connections, circuit boards, wires and other conductive materials and electronics to be embedded within the receptacle. The rim space can by employed in constructing additional power sources, switches or Far UVC photons to be cached from view. The Far-UVC receptacle measuring approximately 1.5 mm will provide the needed space to encompass all components needed to function produce the wavelengths while maintaining an esthetic appearance of the cap.

The rim may also include an energy mechanism to activate the Far-UVC electromagnetic wavelengths. Incidentally, the energy mechanism can be circular in nature and meant to be concealed in the rim with a material exterior covering. One example might be a touch press mechanism to energize the Far-UVC photos. The touch press mechanism can again be pressed to turn off the Far-UVC wave. The energy mechanism will provide the wearer with ease of use in turning on the power.

Referring to FIG. 2, the Far-UVC electromagnetic wavelengths projects within a range of about 90 degrees to about 120 degrees, relative to the rim axis.

In this form, the cap includes an externally mounted Far-UVC holder to house and/or receive at least two or more lower Far-UVC photons in a fixed orientation directing wavelengths along the axis T to an area forward and below the rim. The Far-UVC holder and its components may be made from a water resistant and/or flexible material such as a rubber or plastic material so that the Far-UVC receptacle can be manipulated and bend with the cap rim. The material used to make the Far-UVC receptacle may further be opaque such that electromagnetic wavelengths emitted substantially cannot pass therethrough to prevent stray light from getting into the eyes of a wearer of causing a glare in eyeglasses worn by a wearer.

The Far-UVC photons emitters may be subject to high heat intensity. To address this, the receptacle may incorporate a heat cavity herein, such as composed of tin, aluminum, tin, or other conductive materials for the purpose of circulating out the heat generated by the Far-UVC photons. The heat cavity may be in the thermal exchange with the Far-UVC photons and placed within the receptacle and rim.

There are multiple and alternative specifications, materials, and preparations of the pieces and components that have been explained and diagramed in order to elaborate on the various embodiments of the Wearable Far-UVC caps. The caps claimed may be made by those skilled in the art within the principle and scope of the invention.

What is claimed is:

1. A wearable Far-UVC head article for anti-virus protection comprising:

a cap for fitting over the head having a forward outwardly extending brim therefrom, with the brim having an outer perimeter edge and top and bottom surfaces;

a inner edge of the brim is attached to the cap;

a far-UVC holder is positioned on the bottom surface of the brim substantially adjacent to the outer perimeter edge;

a plurality of far-UVC photons emitting a wavelength of approximately 222 nm is secured to the far-UVC holder substantially downward between about 90 degrees to about 120 degrees perpendicular to a horizontal axis of the brim and not projecting onto the face and eyes.

2. A wearable Far-UVC head article comprising a power source of one of a rechargeable battery, solar power, electromagnetism or acoustic sound.

3. A wearable Far-UVC head article of claim 1 comprising the cap including one of a baseball cap, sunhats, and cowboy hats.

* * * * *